United States Patent [19]

McMath

[11] 4,418,730

[45] Dec. 6, 1983

[54] AUTOMATIC SHUT-OFF NOZZLE WITH VAPOR RETURN SEAL

[75] Inventor: Jack A. McMath, Fort Thomas, Ky.

[73] Assignee: Dover Corporation, N.Y.

[21] Appl. No.: 357,692

[22] Filed: Mar. 12, 1982

Related U.S. Application Data

[63] Continuation of Ser. No. 197,630, Oct. 16, 1980, abandoned, which is a continuation of Ser. No. 59,970, Jul. 23, 1979, abandoned, which is a continuation of Ser. No. 943,326, Sep. 18, 1977, abandoned, which is a continuation of Ser. No. 856,108, Nov. 30, 1976, abandoned, which is a continuation of Ser. No. 66,441, May 7, 1976, abandoned.

[51] Int. Cl.[3] ..... B65B 3/18

[52] U.S. Cl. ..... 141/207; 141/208; 141/226

[58] Field of Search ..... 141/1, 44, 46, 52, 59, 141/93, 97, 128, 198, 206–229, 290, 301, 302, 311 R, 346, 347, 392

[56] References Cited

U.S. PATENT DOCUMENTS

| | | | |
|---|---|---|---|
| 2,582,195 | 1/1952 | Duerr | 141/209 |
| 3,085,600 | 4/1963 | Briede | 141/225 |
| 3,811,486 | 5/1974 | Wood | 141/208 |
| 3,817,285 | 6/1974 | Wilder et al. | 141/206 |
| 4,031,930 | 6/1977 | Sutcliffe et al. | 141/207 |
| 4,133,355 | 1/1979 | Mayer | 141/226 |

*Primary Examiner*—Stephen Marcus
*Assistant Examiner*—Kenneth S. Putnam
*Attorney, Agent, or Firm*—Kinney and Schenk

[57] ABSTRACT

Liquid flow through an automatic shut-off nozzle is automatically stopped if the fill pipe opening of the tank being filled is not sealed so that vapor return means can carry vapor from a tank being filled to vapor recovery equipment. If the sealing means is not effective when the spout is disposed in a fill pipe opening, a valve, which controls the liquid flow through the body of the nozzle, is automatically shut off.

8 Claims, 10 Drawing Figures

AUTOMATIC SHUT-OFF NOZZLE WITH VAPOR RETURN SEAL

This is a continuation of application Ser. No. 197,630, filed Oct. 16, 1980, which is a continuation of Ser. No. 59,970 filed July 23, 1979, which is a continuation of 943,326 filed Sept. 18, 1977, which is a continuation of Ser. No. 856,108 filed Nov. 30, 1976, which is a continuation of Ser. No. 66,441 filed May 7, 1976 all abandoned.

When filling a vehicle tank with gasoline through a dispensing nozzle, vapors from gasoline within the tank can be prevented from escaping through the fill pipe opening in which the spout of the nozzle is inserted by sealing the fill pipe opening. Thus, the escape of the gasoline vapors into the atmosphere is prevented so that pollution of the atmosphere is decreased. The vapors within the tank can be recovered through vapor recovery equipment utilized in conjunction with the nozzle.

However, if the fill pipe opening to the vehicle tank is not sealed by the sealing means when the spout is inserted into the fill pipe of the tank, then the vapors can escape fronm the tank being filled to the atmosphere. Thus, if the sealing means is not, effective, collection of the vapors is not obtained.

While the attendant could normally ascertain by visual inspection that a seal on the nozzle is disposed around the fill pipe opening in sealing relation, there are diversions to the attendant's attention. Furthermore, the seal around the fill pipe opening may fail to function after filling of the tank has started since a force must be continuously exerted on the nozzle to cause the seal to be effective.

The present invention satisfactorily solves this problem of insuring that the seal around the fill pipe opening is effective to enable the vapors in the tank to return to the vapor return means from the tank being filled. The present invention accomplishes this by automatically stopping or preventing the flow of gasoline through the spout to the vehicle tank if the seal is not effective. Accordingly, the present invention prevents the flow of gasoline to the vehicle tank whenever the seal for the vapor return means is not effective to seal around the fill pipe opening.

An object of this invention is to provide an automatic shutoff nozzle for stopping or preventing flow of liquid through the nozzle if the seal for the vapor return means is not effective to seal around the fill pipe opening.

Other objects, uses, and advantages of this invention are apparent upon a reading of this description which proceeds with reference to the drawings forming part thereof and wherein.

Figure 1:
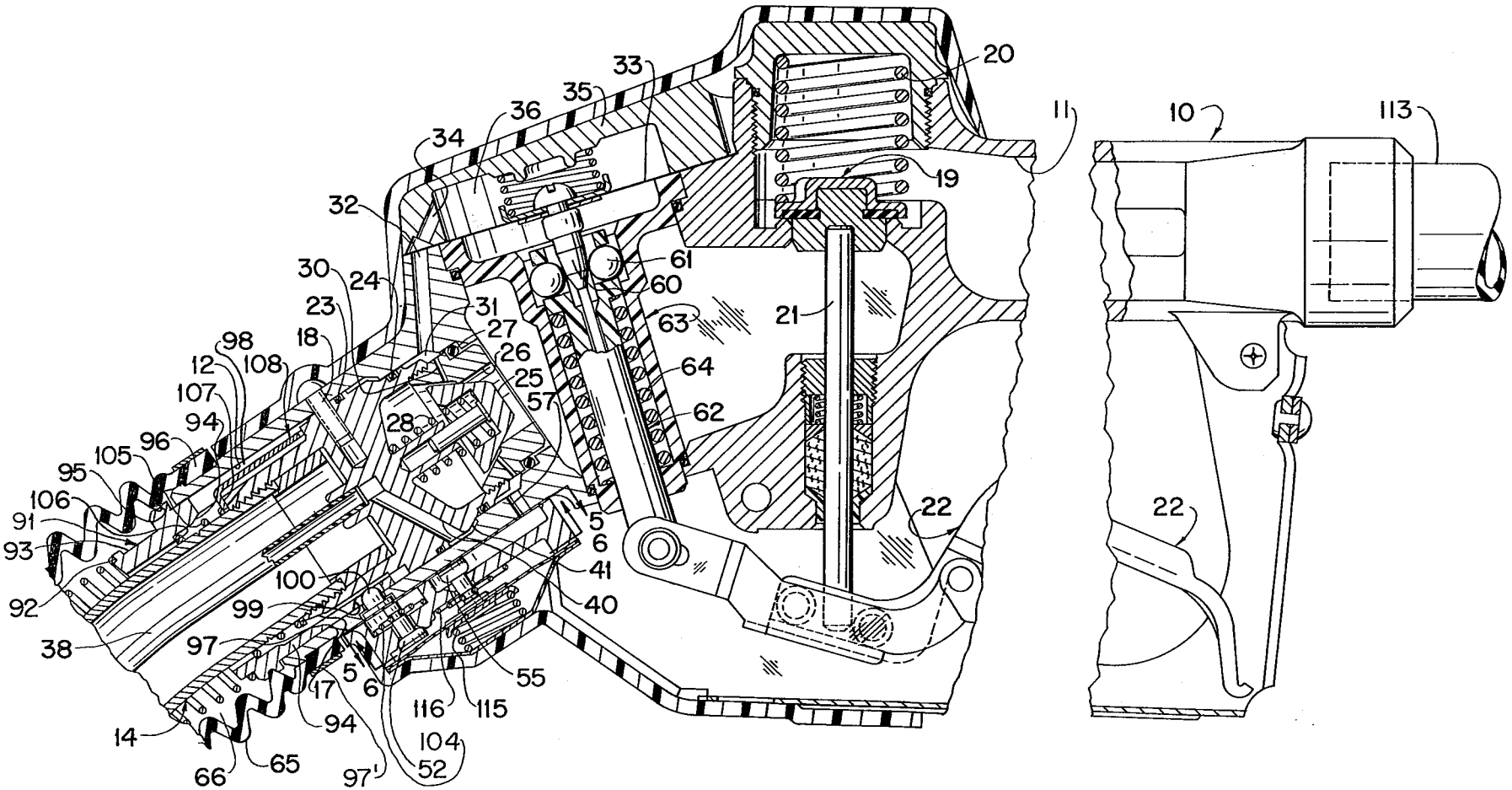
FIG. 1 is a sectional view, partly in elevation, of a portion of the nozzle of the present invention.
Figure 2:
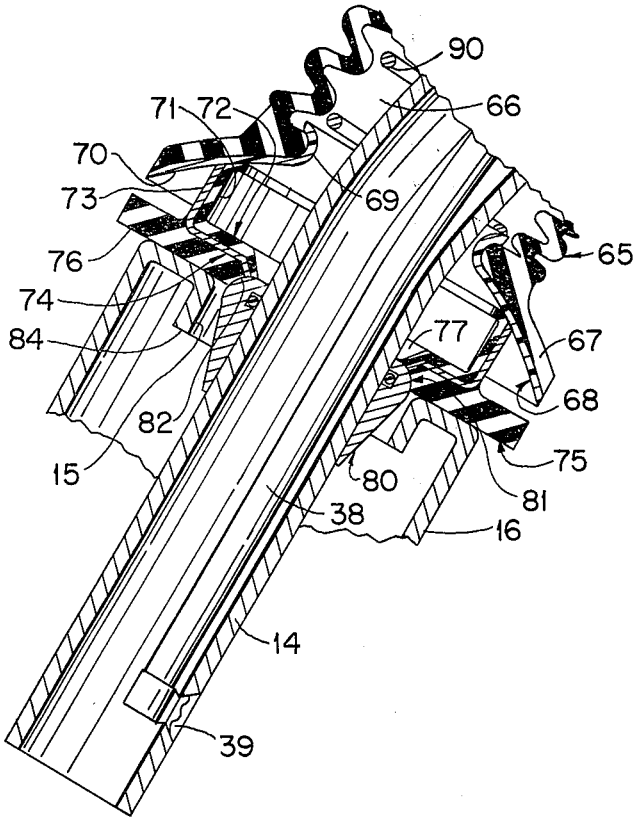
FIG. 2 is a sectional view, partly in elevation, of the remainder of the nozzle of FIG. 1.

Referring to the drawings and particularly FIGS. 1 and 2, there is shown a nozzle body 10 having an inlet 11 to which a hose is connected to supply liquid such as gasoline, for example, to the interior of the body 10. The body 10 has an outlet 12 with which a spout 14 communicates to receive liquid from the interior of the body 10.

The spout 14, which is adpated to be inserted within an opening 15 (see FIG. 3) in a fill pipe 16 of a vehicle tank such as an automobile fuel tank, for example, has an end threaded in a spout adapter 17 (see FIG. 1), which is connected to the outlet 12 of the body 10 by a screw 18. The screw 18 is preferably formed of a material that will break or shear when subjected to a predetermined force. Thus, if the spout 14 should be retained in a vehicle tank when the vehicle is moved, the screw 18 breaks or shears and allows the spout adapter 17 to be pulled from the body 10 without any damage to the body 10 or to the pump to which the body 10 is connected by a hose.

The body 10 has a first or main poppet valve 19 supported therein for control of the flow of liquid from the inlet 11 to the interior of the body 10 and from the interior of the body 10 ot the outlet 12. A spring 20 continuously urges the poppet valve 19 to its closed position in which flow from the inlet 11 to the outlet 12 is stopped or prevented.

A stem 21 is connected to the poppet valve 19 and has its lower portion extending exteriorly of the body 10. The valve stem 21, which is slidably disposed within the body 10, is moved by a manually operated lever or handle 22. The stem 21 passes through the body 10 in the same manner as described in U.S. Pat. No. 3,811,486 to Wood.

A second poppet valve 25 is slidably mounted on the spout adapter 17 and is continuously urged by spring 28 into engagement with a seat ring 26, seat ring 26 is secured to the spout adapter 17 by a threaded connected. A sealing ring 27 is disposed about seat ring 26 to prevent liquid leakage into annular chamber 31. Thus, only the pressure of liquid going from the inlet 11 and past the valve 19 can overcome the spring 28 and move the poppet valve 25 to an open position.

As the liquid flows between the poppet valve 25 and the seat ring 26, a venturi effect is created in radially extending passages 30 in the seat ring 26. The outer ends of the passages 30 communicate with annular chamber 31, which is formed between the body 10, the spout adapter 17, and the seat ring 26. The passages 30 communicate through the chamber 31, a passage 32 in the body 10, an opening in a diaphragm 33 and a passage 34 in a cap 35 to a chamber 36, which is formed between the diaphragm 33 and the cap 35.

Sealing rings 23 and 24 are disposed between the spout adapter 17 in the body 10. These prevent air from entering the chamber 31 from exterior of the body 10.

Figure 5:
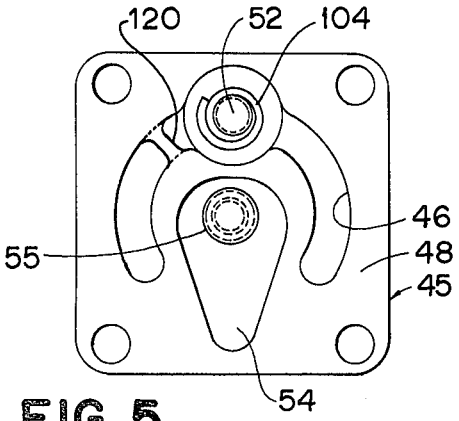
FIG. 5 is an end elevational view of a housing of the present invention and taken along line 5—5 of FIG. 1.
Figure 6:
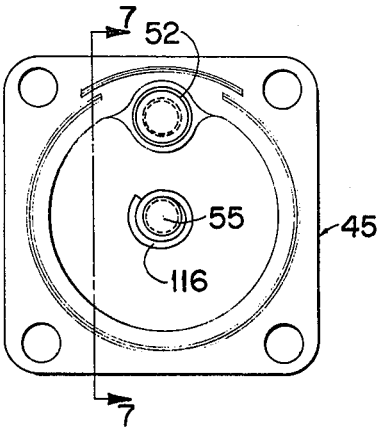
FIG. 6 is an end elevational view of the housing of FIG. 5 taken along line 6—6 of FIG. 1.
Figure 7:
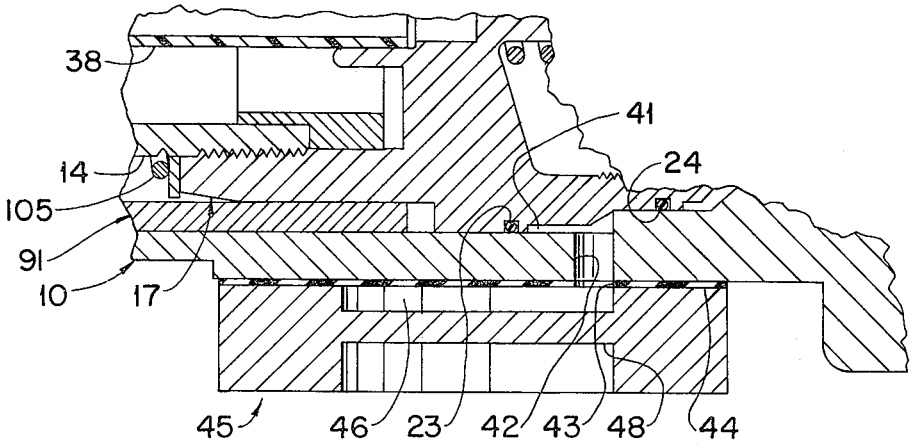
FIG. 7 is a sectional view of the housing of FIGS. 5 and 6 and taken along line 7—7 of FIG. 6.

The chamber 31 also communicates with a vacuum tube 38, which is connected with an opening 39 (see FIG. 2) in the spout 14 adjacent the discharge or free end of the spout 14. The tube 38 communicates through a passage 40 (see FIG. 1) in the spout adapter 17 wwith a chamber 41, which is formed between the sealing rings 23 and 24, the spout adapter 17, and the body 10. As shown in FIG. 7, the chamber 41 communicates through a passage 42 in the nozzle body 10 and an opening 43 in a diaphragm 44, which is disposed between the body 10 and a housing 45 secured to the body 10, to a horseshoe-shaped passage 46 (see FIG. 5) in the housing 45.

Bridge 120 is provided across passage 46 to provide a support for diaphragm 44 to prevent undue flexing of diaphragm 44 and thereby eliminating air leakage around diaphragm 44.

The horseshoe-shaped passage 46 in the housing 45 communicates through a passage 47 (see FIG. 4) in a divider 48 of the housing 45 with a chamber 49, which is formed between the divider 48 and a diaphragm 50. A retainer 51 holds the diaphragm 50 on the housing 45. The flow through the passage 47 is controlled by a poppet valve 52.

The chamber 49 communicates through a passage 53 in the divider 48 of the housing 45 with a chamber 54, which is formed within the housing 45 between the divider 48 and the diaphragm 44. The passage 53 is controlled by a poppet valve 55, which is responsive to the diaphragm 50. The chamber 54 communicates through an opening 56 in the diaphragm 44 and a passage 57 in the body 10 with the annular chamber 31.

Accordingly, as long as the poppet valves 52 and 55 are open and the opening 39 is not closed due to the liquid within the tank reaching a predetermined level that indicates that the tank is filled, the venturi effect created by the flow of the liquid between the seat ring 26 (see FIG. 1) and the poppet valve 25 draws air through the tube 38 to create a partial vacuum within the chamber 36. However, as soon as the opening 39 is blocked, the valve 52 is closed, or the valve 55 is closed, the chamber 36 has its pressure reduced due to the air therein being drawn therefrom because of the venturi effect in the passage 30 whereby the diaphragm 33 moves upwardly since the partial vacuum in the chamber 36 is increased. This venturi effect is more particularly described in U.S. Pat. No. 3,085,600 to Briede.

The diaphragm 33 has a latch retaining pin 60 secured thereto for movement therewith and disposed between three balls 61 (two shown), which are positioned within passages in a latch plunger 62. When the latch retaining pin 60 is in the position shown in FIG. 1, the balls 61 prevent downward movement of the plunger 62, which is slidably mounted within an insert 63. The insert 63, which is preferably formed of a plastic, is supported in the body 10.

When the diaphragm 33 is moved upwardly due to the increase in the partial vacuum in the chamber 36, the latch retaining pin 60 is moved upwardly therewith. The upward movement of the retaining pin 60 disposes a tapered portion of the retaining pin 60 between the balls 61 whereby the balls 61 may move inwardly to allow the plunger 62 to be moved downwardly against the force of its spring 64. The correlation between the tapered portion of the pin 60 and the latch plunger 62 is more specifically shown in U.S. Pat. No. 2,582,195 to Duerr.

The lower end of the plunger 62 is connected to the handle 22 as more particularly shown and described in U.S. Pat. No. 3,817,285 to Wilder et al. Thus, when the diaphragm 33 moves upwardly to pull the latch retaining pin 60 and release the latch plunger 62 from the balls 61, the force of the spring 20 closes the main poppet valve 19 as more particularly shown and described in the aforesaid Wilder patent.

The body 10 has a bellows 65, which is preferably formed of a gasoline resistant synthetic rubber, secured thereto and extending from the outlet 12 of the body 10 towards the free or discharge end of the spout 14. The bellows 65 is disposed in spaced relation to the spout 14 to form an annular passage 66 therebetween.

The end of the bellows 65 remote from the outlet 12 of the body 10 has a member 67 (see FIG. 2), which is preferably formed integral therewith. The member 67 has a member 68, which is plastic such as Delrin, for example, connected thereto by the member 68 having its curved portion snapped into the bellows 65 and retained therein by the resilience of the bellows 65. The member 68 has an opening 69 formed in the center thereof to enable the member 68 to slide along the spout 14.

The member 68 has its surface 70 formed as a sector of a sphere so that a cylindrical extension 71 of a member 72, which is preferably formed of the same material as the member 67, engages the surface 70 irrespective of the position of the member 72 on the spout 14. The member 72 has its cylindrical extension 71 supported by a cylindrical extension 73 of a plate 74, which is preferably formed of a suitable metal such as stainless steel, for example. The member 72 is molded integral with the plate 74, so that the cylindrical extension 71 of the member 72 is secured to the cylindrical extension 73 of the plate 74.

The plate 74 has openings formed therein so that the member 72 has a disc 75, disposed on the opposite side of the plate 74 from the cylindrical extension 71. Thus, the member 72, the plate 74, and the disc 75 form a sealing member with the disc 75 having its flat surface 76 functioning as a sealing surface. The member 72, the plate 74, and the disc 75 have an opening 77 to enable them to be both slidably and rotatably mounted on the spout 14.

A retainer 80, which functions as a stop, is fixed to the spout 14 between the disc 75 and the discharge or free end of the spout 14 by suitable means such as a set screw or welding, for example. The retainer 80 has a curved surface 81, preferably formed as a portion of a sphere as more particularly shown and described in the copending patent application of Donald A. Lasater for "Liquid Dispensing Nozzle Having Vapor Recovery And Sealing Arrangement," Ser. No. 581,718 filed May 29, 1975 now U.S. Pat. No. 4,003,415, and assigned to the same assignee as the assignee of this application. The disc 75 has an inner curved surface 82, preferably formed as a sphere as more particularly shown and described in the aforesaid Lasater application, engaging the curved surface 81 of the retainer 80 to form a seal therewith when the spout 14 is not inserted within the opening 15 of the fill pipe 16.

The retainer 80 has an inner flat surface 83, which is disposed inside of the surface 81. The surface 83 functions to lock the spout 14 within the fill pipe 16 through cooperation with a lip 84 of the fill pipe 16 as shown in FIG. 3.

Accordingly, when the spout 14 is not inserted in the opening 15 of the fill pipe 16, the annular passage 66, which is connected to the vapor recovery equipment, is not connected to the atmosphere but is sealed through the cylindrical extension 71 of the member 72 engaging the surface 70 of the member 68 and the disc 75 having its inner curved surface 82 engage the outer curved surface 81 of the retainer 80 as shown in FIG. 2. When the spout 14 is inserted into the opening 15 (see FIG. 3) of the fill pipe 16, the outer flat surface 76 of the disc 75 abuts the end of the fill pipe 16 so as to not follow the movement of the spout 14 and the retainer 80 into the fill pipe 16. This results in the bellows 65, which continuously urges the member 68 toward the free end of the spout 14 so that the spherical surface 70 of the member 68 is always in engagement with the cylindrical extension 71 of the member 72 and the cylindrical extension 73 of the plate 74, being slightly compressed.

Figure 3:
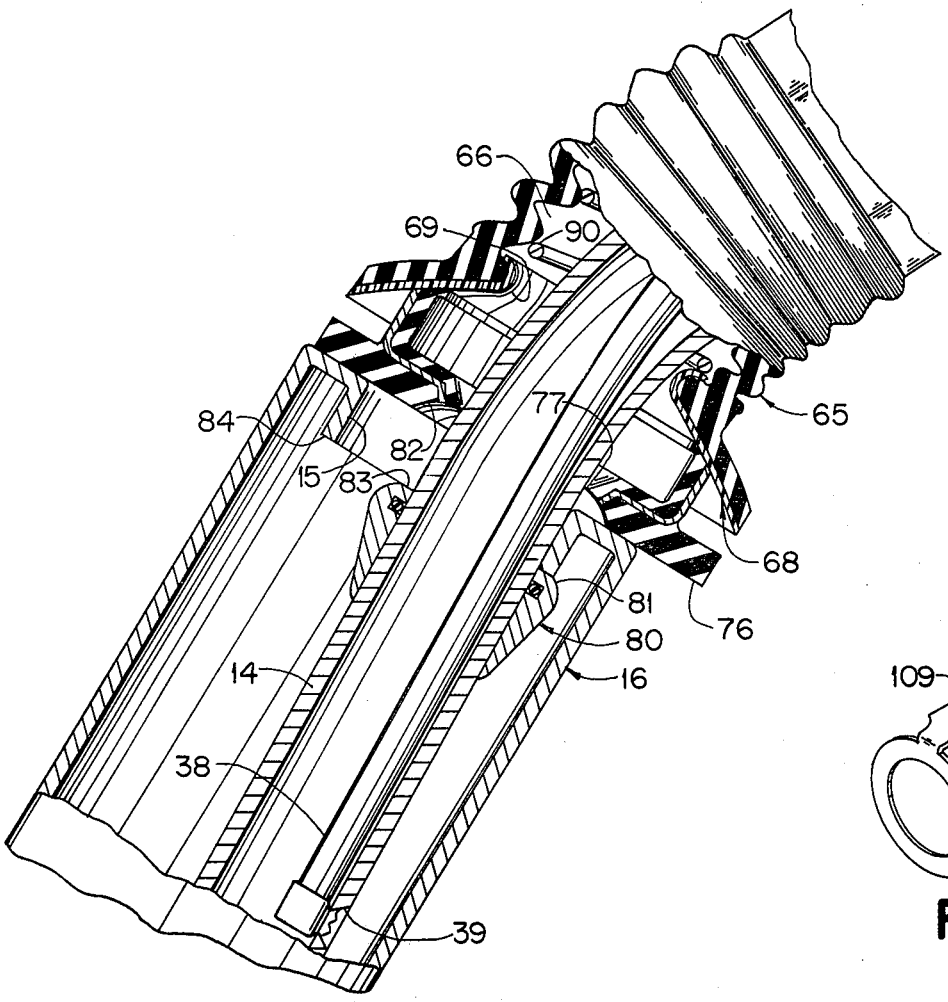
FIG. 3 is a sectional view, partly in elevation, of the same portion of the nozzle of FIG. 1 as in FIG. 2 but showing the spout in the fill pipe of a vehicle tank and the relationship when the seal of the vapor return means is effective.

Accordingly, when the spout 14 is in the position of FIG. 3, vapor within the tank can flow through the opening 15 in the fill pipe 16 and the opening 69 into the annular passage 66 from which it flows to the vapor recovery equipment. Thus, the movement of the spout 14 into the fill pipe opening 15 results in the seal between the disc 75 and the retainer 80 being broken whereby the vapor can be removed from the tank being filled.

When the sealing surface 76 and the disc 75 engages the end of the fill pipe 16 so as to not follow the movement of the spout 14 and the retainer 80 into the fill pipe opening 15, this stopping of the movement of the disc 75 is transmitted through a spring 90 to an interlock sleeve 91 (see FIG. 1), which surrounds the spout 14 and a portion of the spout adapter 17 and extends between the outlet 12 of the body 10 and the spout adapter 17. The interlock sleeve 91 has a shoulder 92 on one end and against which one end of the spring 90 bears. The other end of the spring 90 abuts the member 68 as shown in FIG. 2. As shown in FIG. 1, the shoulder 92 is formed at an angle to the longitudinal axis of the sleeve 91 so that a force is produced on the top of the spout 14 substantially equal to the force on the bottom when the spout 14 is inserted into the fill pipe opening 15. The shoulder 92 is formed at an angle to the longitudinal axis of the sleeve 91 to have the direction of the spring 90 conform to the configuration of the spout 14.

To provide the shoulder 92 at an angle to the longitudinal axis of the sleeve 92, the sleeve 91 has its head 93 formed so that it decreases in size from the top to the bottom. A cylindrical-shaped skirt 94 extends from the head 93 and is disposed between the body 10 and the spout adapter 17.

A groove 95 is formed in the head 93 of the interlock sleeve 91 adjacent the skirt 94. A portion of the bellows 65 is disposed in the groove 95 and retained therein by being squeeze fitted, for example, in the groove 95 so as to prevent leakage through the groove 95. Thus, the bellows 65 and the interlock sleeve 91 move together.

The bellows 65 also is secured to the body 10. The bellows 65 has an enlarged portion 96 for disposition in a groove 97 in the periphery of the body 10. A clamp 97' is disposed around the enlarged portion 96 of the bellows 65 to hold the enlarged portion 96 in the groove 97.

The skirt 94 has a longitudinal slot 98 therein. A cam surface 99 is formed in the skirt 94 diametrically opposite to the longitudinal slot 98 for cooperation with an actuator pin 100, which is disposed in a passage 101 (see FIG. 4) in the body 10.

Accordingly, when the spout 14 is disposed in the fill pipe opening 15 so that the flat surface 76 of the disc 75 engages the end of the fill pipe 16 to stop movement of the disc 74, the continued movement of the spout 14 into the fill pipe opening 15 causes the body 10, which has the spout 14 attached thereto through the spout adapter 17, to move relative to the interlock sleeve 91. As a result the actuator pin 100, which has an end disposed within a passage 102 in the skirt 94 of the interlock sleeve 91, moves with the body 10 so as to move into engagement with the cam surface 99 in the skirt 94 of the interlock sleeve 91. The engagement of the actuator pin 100 with the cam surface 99 cams the actuator pin 100 from the position of FIG. 1 to the position of FIG. 4.

The actuator pin 100 has its head 103 bearing against the diaphragm 44 and acting therethrough on one end of the poppet valve 52. A spring 104 continuously urges the poppet valve 52 to its closed position of FIG. 1 in which it blocks the passage 47. The spring 104 also urges the actuator pin 100 into the passage 102 in the skirt 94 of the interlock sleeve 91 so that the actuator pin 100 cannot be moved out of the passage 102 except by the cam surface 99.

Thus, when there is relative movement between the interlock sleeve 91 and the spout 14 due to the spout 14 being inserted in the fill pipe opening 15 and the flat surface 76 of the disc 75 abutting the end of the fill pipe 16 with sufficient force to effectively form a seal around the fill pipe opening 15, the poppet valve 52 is moved to an open position, through the actuator pin 100 acting on the end of the poppet valve 52 through the diaphragm 44. The opening of the poppet valve 52 allows air to flow from the inlet opening 39 (see FIG. 3) in the spout 14 and through the vacuum tube 38, the passage 40 (see FIG. 4) in the spout adapter 17, the annular chamber 41, the passage 42 (see FIG. 7) in the body 10, the opening 43 in the diaphragm 44, the passage 46 in the housing 45, the passage 47 (see FIG. 4) in the divider 48, the chamber 49, the passage 53 in the divider 48, the chamber 54, the opening 56 in the diaphragm 44, the passage 57 in the body 10, and the annular chamber 31 to the passages 30 in the seat ring 26. This provides a supply air so that the partial vacuum created in chamber 36 (see FIG. 1) by the venturi effect is not increased.

Accordingly, the interlock sleeve 91 allows flow through the body 10 only if the disc 75 has the flat surface 76 in sealing engagement with the end of the fill pipe 16 when the spout 14 is inserted in the fill pipe opening 15 to supply the liquid thereto. If the flat surface 76 of the disc 75 does not engage the end of the fill pipe 16 with sufficient force to form a seal around the fill pipe opening 15, then there will not be the desired relative motion of the spout 14, the spout adapter 17, and the body 10 with respect to the interlock sleeve 91. This prevents the poppet valve 52 from being opened so that air is not supplied to the passages 30 in the seat ring 26. The lack of air to the passage 30 in the seat ring 26 causes the partial vacuum in the chamber 36 to increase to close the main poppet valve 19 so that liquid cannot flow through the body 10 and the spout 14.

It should be understood that the main poppet valve 19 must be opened and flow to occur for the partial vacuum to be produced in the chamber 36. However, only a small amount of liquid will flow through the spout 14 before the poppet valve 19 is automatically closed by the increased partial vacuum in the chamber 36. This is because the poppet valve 52 always is closed unless the flat surface 76 of the disc 75 is engaging the end of the fill pipe 16 with sufficient force to effectively form a seal around the fill pipe opening 15 and the spout 14 has been inserted into the fill pipe opening 15 a sufficient distance to produce the necessary relative motion to cause the poppet valve 52 to be opened.

Therefore, the poppet valve 52 is closed unless necessary relative motion has occurred. As a result of the poppet valve 52 being closed, opening of the main poppet valve 19 to produce the necessary flow past the passages 30 in the seat ring 26 to produce the partial vacuum in the chamber 36 automatically increases the partial vacuum in the chamber 36 whereby the main poppet valve 19 is automatically closed shortly after being opened.

When the spout 14 is removed from the fill pipe opening 15 so that the flat surface 76 of the disc 75 does not engage the end of the fill pipe 16, a return spring 105 (see FIGS. 1 and 4), which acts between the inner flange 106 on the interlock sleeve 91 and a ring 107 of a guide 108, produces the relative motion of the spout 14, the spout adapter 17, and the body 10 with respect to the interlock sleeve 91. Thus, the interlock sleeve 91 moves relative to the actuator pin 100 which is within the body 10 at this time, to that the pin 100 can again enter the passage 102 in the skirt 94 of the interlock sleeve 91. When this occurs, the poppet valve 52 is returned to its closed position by the spring 104. Closing of the poppet valve 52 stops air flow through the vacuum tube 38 so that the diaphragm 33 is caused to move upwardly to release the latch plunger 62 from the balls 61 whereby the spring 20 closes the main poppet valve 19 to automatically stop flow of liquid through the body 10 if it has not been stopped by the manually operated handle 22.

Figure 8:
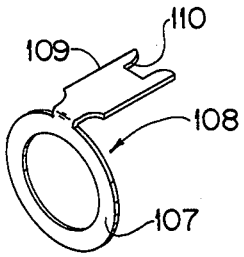
FIG. 8 is a perspective view of a guide.

The guide 108 has a leg 109 (see FIGS. 1 and 8) extending from the ring 107 and formed with a slot 110 in its end. The slot 110 aligns the guide 108 with the spout adapter 17.

The ring 107 of the guide 108 is continuously urged against the end of the spout adapter 17 by the return spring 105. The leg 109 of the guide 108 cooperates with the longitudinal slot 98 in the interlock sleeve 91 to insure that the interlock sleeve 91 is properly oriented so that the actuator pin 100 is received in the passage 102 of the interlock sleeve 91.

Figure 10:
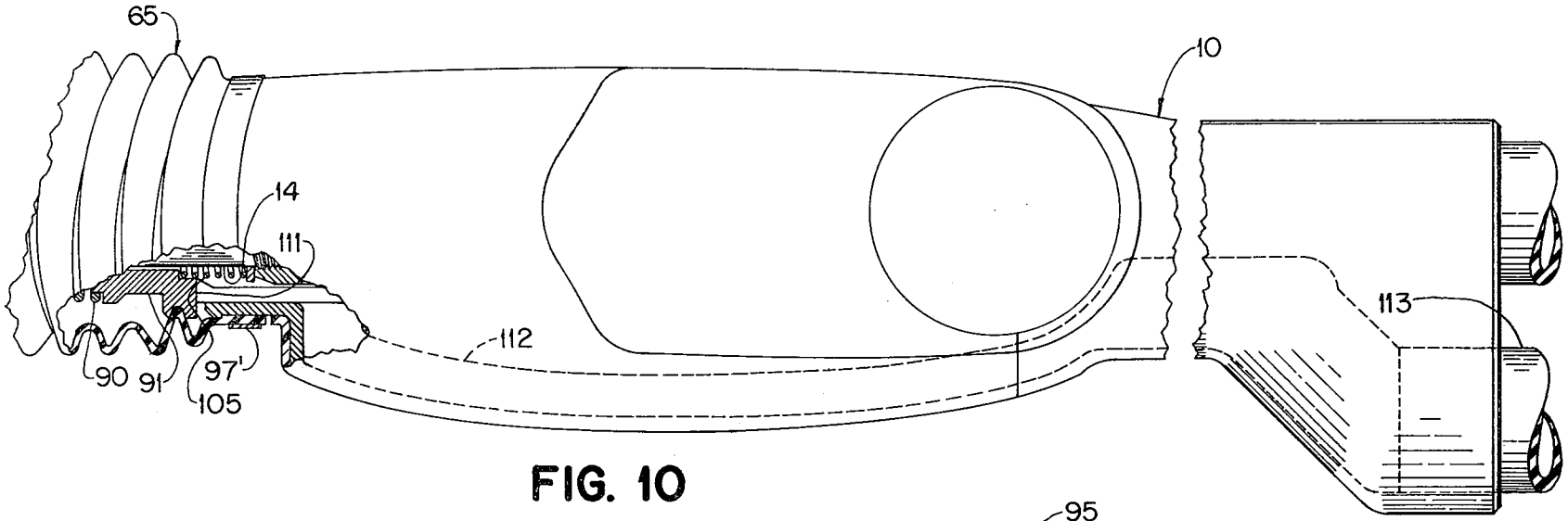
FIG. 10 is a fragmentary top plan view of the nozzle of FIG. 1.
Figure 9:
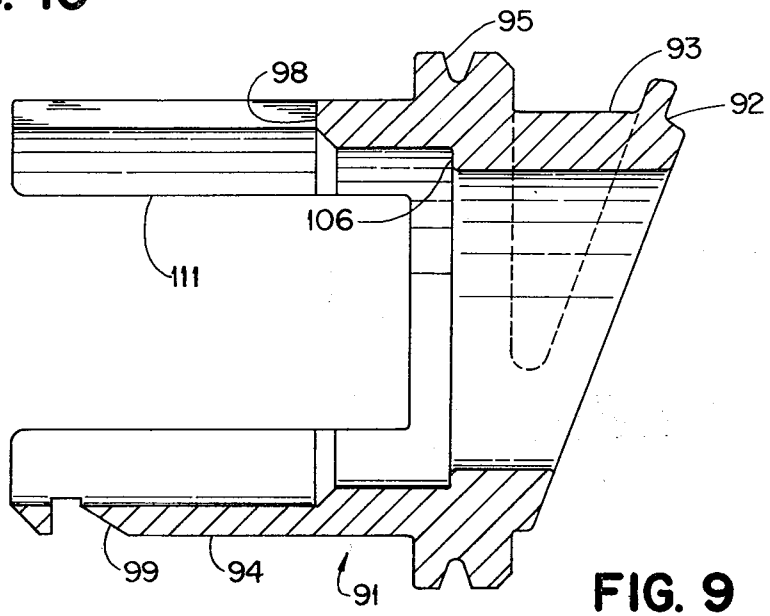
FIG. 9 is a sectional view of an interlock sleeve.

The skirt 94 of the interlock sleeve 91 has a longitudinal cut out portion 111 (see FIG. 10) formed therein with its centerline 90° from the centerline of the slot 98. The cut out portion 111, which extends for the length of the skirt 94, provides communication from the interior of the interlock sleeve 91 to a vapor return passage 112 in the body 10. The vapor return passage 112 communicates through a hose 113 (see FIGS. 1 and 10) with the vapor recovery equipment. By extending the longitudinal cut out portion 111 for the length of the skirt 94 of the interlock sleeve 91, this insures that the movement of the interlock sleeve 91 will not prevent communication from the interior thereof to the vapor return passage 112 in the body 10.

As previously mentioned, the poppet valve 55 is responsive to the diaphragm 50, which has one end of a spring 115 acting thereagainst. the other end of the spring 115 acts against the retainer 51. A spring 116 has one end disposed in a groove 117 (see FIG. 4) in the poppet valve 50 so that the spring 116 urges the poppet valve 55 to its closed position, but the force of the spring 116 is not as strong as the force of the spring 115, which urges the poppet valve 55 to its normally open position through a rivet 118 (see FIG. 4) in the diaphragm 50 being held against the end of the poppet valve 55 by the spring 115.

However, if the vapor pressure in the tank, which is being filled and has the fill pipe opening 15 sealed by the flat surface 76 of the disc 75 engaging the end of the fill pipe 16, increases beyond a predetermined pressure, the diaphragm 50 is moved against the force of the spring 115 to permit the poppet valve 55 to move to its closed position in response to the action of the spring 116. When this occurs, air from the inlet 39 to the passages 30 in the seat ring 26 is stopped so that the partial vacuum in the chamber 36 is increased to cause automatic closing of the main poppet valve 19. This response of the diaphragm 50 to the vapor pressure in the sealed tank is more particularly shown and described in the aforesaid Wood patent.

Considering the operation of the present invention, the poppet valve 52 is normally in a closed position and the poppet valve 55 is normally in an open position as shown in FIG. 1. With the valve 52 and 55 in these positions and the spout 14 not disposed in the fill pipe opening 15 opening of the main poppet valve 19 by the handle 22 to cause liquid to flow through the body 10 produces an increased partial vacuum in the chamber 36 whereby the main poppet valve 19 is automatically closed shortly after being opened so that only a small amount of liquid can pass through the body 10 and the spout 14.

Figure 4:
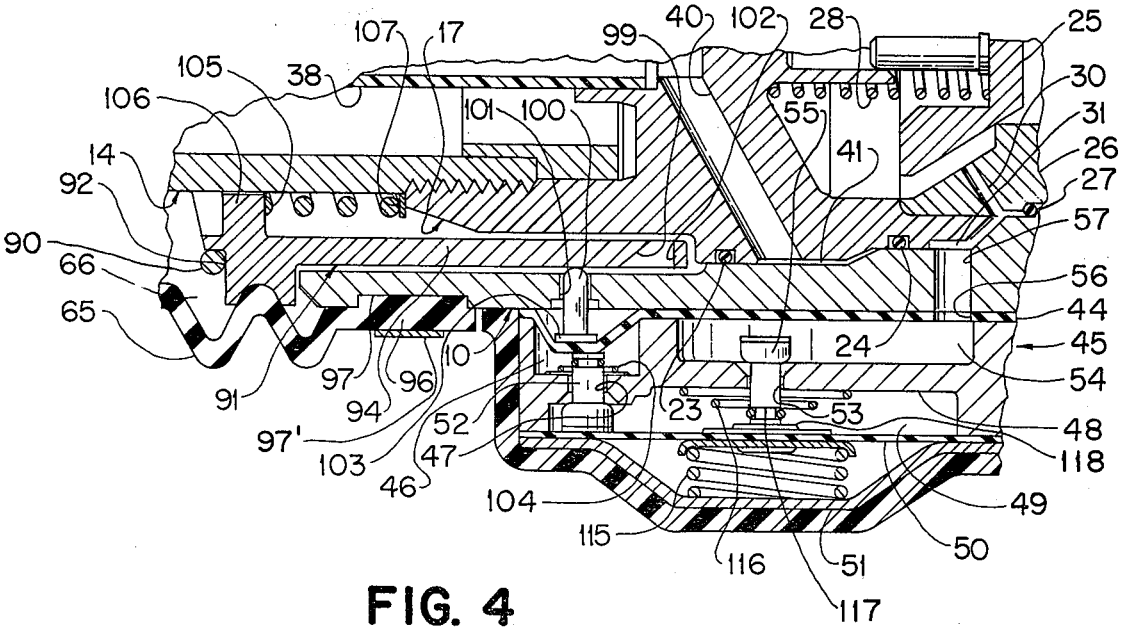
FIG. 4 is an enlarged fragmentary longitudinal sectional view showing the relationship of the elements for allowing flow when the seal of the vapor return means is effective with the spout disposed in the fill pipe opening.

When the spout 14 is disposed in the fill pipe 16 a sufficient distance that the flat surface 76 of the disc 75 engages the end of the fill pipe 16 and a sufficient force is exerted on the spout 14 to cause the force of the flat surface 76 of the disc 75 against the end of the fill pipe 16 to be sufficient to provide a seal around the fill pipe opening 15, then the poppet valve 52 is moved to its open position of FIG. 4 through the relative motion of the body 10, the spout 14, and the spout adapter 17 with respect to the interlock sleeve 91. This relative motion results in the cam surface 99 of the interlock sleeve 91 moving the actuator pin 100 against the force of the spring 104 to open the poppet valve 52 through the head 103 of the actuator pin 100 acting against the end of the poppet valve 52 via the flexibility of the diaphragm 44 as shown in FIG. 4.

With the poppet valve 52 in the open position of FIG. 4, there is an effective seal by the flat surface 76 of the disc 75 against the end of the fill pipe 16 so that liquid can be supplied to the tank from the body 10. Thus, vapor will flow from the tank, which is being filled to the annular passage 66.

Flow will continue through the body 10 and the spout 14 until the tank is filled to a predetermined level at which the inlet 39 to the vacuum tube 38 is blocked. When this occurs, the partial vacuum in the chamber 36 increases because of the absence of air from the inlet 39 to the passages 30 in the seat ring 26 so that the diaphragm 33 moves upwardly to cause automatic closing of the main poppet valve 19.

If the vapor pressure in the tank should exceed a predetermined pressure, then the diaphragm 50 moves against the force of the spring 115 to permit the poppet valve 55 to move to its closed position in response to the action of the spring 116. When this occurs, the partial vacuum in the chamber 36 is increased in the same manner as when the inlet 39 to the vacuum tube 38 is blocked by the level of the liquid in the tank being filled since each effectively causes an increase in the partial vacuum in the chamber 36 because of the inability of the venturi to draw air from the inlet 39 through the passages 30 in the seat ring 26.

When the spout 14 is to be withdrawn from the fill pipe 16, the main poppet valve 19 normally has been manually closed through the handle 22. If the valve 19 should not have been closed for some reason, automatic closing thereof will occur as soon as the spout 14 starts to be withdrawn from the fill pipe opening 15. This is because the return spring 105 moves the interlock sleeve 91 from the position of FIG. 4 to the position of FIG. 1 to return the poppet valve 52 to its closed position. When this occurs, the partial vacuum in the chamber 36 increases to automatically close the main poppet valve 19.

Even if the main poppet valve 19 is closed before the spout 14 is withdrawn from the fill pipe 16, the relative motion of the spout 14, the spout adapter 17, and the body 10 with respect to the interlock sleeve 91 still occurs so that the interlock sleeve 91 is returned from the position of FIG. 4 to the position of FIG. 1 by the return spring 105. This returns the poppet valve 52 to its closed position. Thus, the position of the poppet valve 52 in FIG. 1 is the inactive position of the nozzle.

While the present invention has shown one type of seal used with the bellows 65, it should be understood that any type of seal can be employed therewith for sealing around the fill pipe opening 15. It is only necessary that there is relative motion of the spout 14, the body 10, and the spout adapter 17 with respect to the interlock sleeve 91 when the spout 14 is inserted into the fill pipe opening 15 and the seal, which is around the fill pipe opening 15, abuts the end of the fill pipe 16 with sufficient force to form a seal.

While the present invention has employed the diaphragm 33 to release the main poppet valve 19 from its open position, it should be understood that any other suitable release means could be employed. It is only necessary that the release means be responsive to the seal around the fill pipe opening 15 not being effective when the spout 14 is inserted into the fill pipe opening 15. This could occur if sufficient force is not exerted on the spout 14 or the spout 14 is not locked in the fill pipe through the retainer 80 cooperating with the lip 84 of the fill pipe 16, for example.

An advantage of this invention is that it insures that the vapor return seal is effective before a significant quanity of liquid can be supplied. Another advantage of this invention is that automatic stopping of flow of liquid through the nozzle body occurs whenever the vapor return seal around the fill pipe opening ceases to be effective.

For purposes of exemplification, a particular embodiment of the invention has been shown and described according to the best present understanding thereof. However, it will be apparent that changes and modifications in the arrangement and construction of the parts thereof may be resorted to without departing from the sprit and scope of the invention.

What is claimed is:

1. An automatic shut-off dispensing nozzle, comprising:

(a) a body, said body having an inlet and an outlet and an internal flow passage therebetween;

(b) a flow control valve disposed in said internal flow passage for controlling flow of liquid from said inlet to said outlet;

(c) manually operated means for controlling the operation of said flow control valve, said manually operated means being movably secured with respect to said body;

(d) a spout secured to said outlet of said body and having its free end for disposition into an opening of a fill tank of a vehicle tank or the like, said spout being in fluid communication with said internal flow passage to receive liquid discharged from said outlet;

(e) means for selectively releasing said manually operated means in response to predetermined conditions to allow closing of said flow control valve and stoppage of liquid flow through said internal passage immediately of said manually operated means, said releasing means including a venturi proximally disposed with respect to said internal flow passage and an air passage in gaseous communication between said venturi and an opening in said spout;

(f) a vapor return passage for returning vapor from a vehicle tank or the like when said spout is disposed in the vehicle tank's fill pipe;

(g) means for establishing a seal between the fill tank opening and the vapor return passage when said spout is inserted into the fill pipe opening;

(h) a divided housing secured to said body, said divided housing including a first chamber in open gaseous communication with the opening in said spout, a second chamber in open gaseous communication with said venturi, a third chamber in selective gaseous communication with said first and second chambers;

(i) an interlock valve disposed between said first and third chambers to selectively block gaseous flow therebetween, said interlock valve being responsive to movement of said spout into the fill pipe after said seal establishing means establishes a seal between the fill tank opening and the vapor return passage; and (j) an excess pressure valve disposed between said second and third chambers to selectively block gaseous flow between said second and third chambers, said excess pressure valve being closable in response to a predetermined gaseous pressure in the fill tank.

2. An automatic shut-off dispensing nozzle as recited in claim 2 further including an interlock sleeve concentrically disposed with respect to said spout and axially translatable with respect thereto, said interlock sleeve being axially translated with respect to said spout by insertion of said spout into the fill pipe after a seal is established between the fill pipe and the vapor return passage, said interlock sleeve including a cam surface operative to control the opening of said interlock valve in response to axial translation of said interlock sleeve with respect to said spout.

3. An automatic shut-off dispensing nozzle as recited in claim 2 wherein said interlock valve is biased to a closed position in which it blocks gaseous communication between said venturi and said opening and is urged to an open position by axial movement of the cam surface of said interlock sleeve with respect to said spout.

4. An automatic shut-off dispensing nozzle as recited in claim 3 further including an actuating pin engaged by the cam surface of said interlock sleeve, said actuating pin being biased to a predetermined position and movable in response to axial translation of said interlock sleeve with respect to said spout to control said interlock valve.

5. An automatic shut-off dispensing nozzle as recited in claim 4 further including a flexible sealing member disposed between said actuating pin and said interlock valve for sealing the vapor return passage from the chambers in said divided housing.

6. An automatic shut-off dispensing nozzle as recited in claim 1 wherein said excess pressure valve is biased to an open position and movable to a closed position.

7. An automatic shut-off dispensing nozzle as recited in claim 1 further including a pressure responsive diaphragm in said third chamber dividing said third chamber into two subchambers, said excess pressure valve being connected to said diaphragm and closable in response to a predetermined gaseous pressure acting upon said diaphragm.

8. An automatic shut-off dispensing nozzle as recited in claim 7 wherein said first chamber has a horseshoe shaped configuration with the second chamber being disposed at least partially within said horseshoe configuration in a common plane with said first chamber, said third chamber being non-planar to both said first and second chambers.

* * * * *